US008936375B2

(12) United States Patent
Lau

(10) Patent No.: US 8,936,375 B2
(45) Date of Patent: Jan. 20, 2015

(54) LIGHTING APPARATUS

(71) Applicant: Ping Sun Lau, Hong Kong (HK)

(72) Inventor: Ping Sun Lau, Hong Kong (HK)

( * ) Notice: Subject to any disclaimer, the term of this patent is extended or adjusted under 35 U.S.C. 154(b) by 226 days.

(21) Appl. No.: 13/648,920

(22) Filed: Oct. 10, 2012

(65) Prior Publication Data

US 2014/0098526 A1 Apr. 10, 2014

(51) Int. Cl.
*F21V 21/30* (2006.01)
*F21L 4/02* (2006.01)

(52) U.S. Cl.
USPC ..... 362/184; 362/249.09

(58) Field of Classification Search
None
See application file for complete search history.

(56) References Cited

U.S. PATENT DOCUMENTS

D151,855 S * 11/1948 Nitardy ..... D26/65
D357,993 S * 5/1995 Yuen ..... D26/65
5,845,885 A * 12/1998 Carnevali ..... 248/181.1
5,941,630 A * 8/1999 Finke et al. ..... 362/371
D564,118 S * 3/2008 Wu ..... D26/63
D581,077 S * 11/2008 Levine ..... D26/62
D581,570 S * 11/2008 Levine ..... D26/62
2007/0097689 A1* 5/2007 Barausky et al. ..... 362/287
2008/0137326 A1* 6/2008 Levine ..... 362/157
2011/0051437 A1* 3/2011 Ng et al. ..... 362/427
2014/0098526 A1* 4/2014 Lau ..... 362/184

* cited by examiner

*Primary Examiner* — Britt D Hanley
(74) *Attorney, Agent, or Firm* — Novoclaims Patent Services LLC; Mei Lin Wong

(57) ABSTRACT

A lighting apparatus includes a light housing, a base mount, an extension member, and a lighting arrangement. The light housing includes a first housing member moveably supported such that the first housing member is capable of rotating about a first longitudinal axis thereof, and a second housing member movably supported such that the second housing member is capable of rotating about a second longitudinal axis thereof. The lighting arrangement is provided in the light housing for forming a plurality of light sources of predetermined intensity, wherein when the first housing member and the second housing member are pivotally moved with respect to each other and rotatably moved about the first longitudinal axis and the second longitudinal axis respectively, the light sources are arranged to selectively and simultaneously provide illumination towards two illumination directions.

19 Claims, 8 Drawing Sheets

LIGHTING APPARATUS

BACKGROUND OF THE PRESENT INVENTION

1. Field of Invention

The present invention relates to a lighting apparatus, and more particularly to a barbeque light in which a lighting arrangement is capable of generating different lighting effects for a wide variety of purposes.

2. Description of Related Arts

A conventional lighting apparatus, such as a conventional barbeque light, usually comprises a light housing, a base mount, an extension tube extended between the base mount and the light housing, and a plurality of illumination devices mounted in the light housing for providing illumination toward an area underneath the light housing. Very often, such a conventional barbeque light is used for providing illumination when a user is conducting barbeque activity, especially when this barbeque activity is conducted at night time and in outdoor environment. The light generated by this conventional barbeque light may be used by the user to inspect the food so as to ensure that all the food is completely cooked.

There are several disadvantages for this type of lighting apparatus. First, the light generated by the barbeque light can only be used for illuminating the area located underneath the light housing. While this arrangement is designed to provide illumination for the food, in some occasions however, people gathering around a barbeque spot may need light for other purposes. For example, the user may want to know what time it is. Since in the situation where the barbeque light is needed, there may not be enough light for the user to see his or her watch clearly. The user may move his or her arm near the barbeque rack so that he or she may see the watch by using the light illuminated by the barbeque light. However, this would mean the user's arm is moved to a location which is very close to the barbeque fire. This may harm the user's arm because it is a common phenomenon for a barbeque activity that the sparks or carbon particulates may come out from the charcoal used for cooking the food.

Second, even if the light housing can be designed to be capable of turning, the lighting apparatus itself cannot be used to perform several tasks. For example, when the light housing is turned so that the illumination devices face toward a user, while the light can be used to allow the user to see his or her watch, the illumination for the food may become attenuated so that other users cannot continue monitoring the conditions of the food. In other words, the light provided by the conventional lighting apparatus is primarily designed for performing a single task at one time. In other words, the conventional lighting apparatus can only provide a single source of light toward a predetermined direction as designed by the manufacturer thereof.

Because of these limitations, in practice, the lighting apparatus as described above is to be used for the designed purpose only. For example, the barbeque light as mentioned above will only be used for providing illumination during barbeque activities.

SUMMARY OF THE PRESENT INVENTION

An object of the present invention is to provide a lighting apparatus such as a barbeque light in which a lighting arrangement and a light housing are arranged to generate different lighting effects for a wide variety of purposes.

Another object of the present invention is to provide a lighting apparatus comprising a light housing which comprises a plurality of housing members, wherein the lighting arrangement is arranged to selectively generate illuminations in at least two different directions corresponding to different orientations of the housing members respectively.

Another object of the present invention is to provide a lighting apparatus comprising a lighting arrangement which is capable of forming a plurality of light sources for accomplishing different objectives.

Another object of the present invention is to provide a lighting apparatus in which a plurality of housing members are individually movable for providing illumination in different directions. In other words, the lighting apparatus of the present invention can be utilized for different purposes at the same time. For example, when the lighting apparatus is used as a barbeque light, one housing member may be used to provide illumination toward a food rack, while another housing member may be pivotally turned and rotated to provide illumination for a user to see his or her watch.

In order to accomplish the above objects, the present invention provides a lighting apparatus, comprising:

a light housing which comprises:

a first housing member moveably supported such that said first housing member is capable of rotating about a first longitudinal axis thereof; and a second housing member movably supported such that said second housing member is capable of rotating about a second longitudinal axis thereof, wherein said second housing member is pivotally movable with respect to said first housing member;

a base mount;

an extension member extended between said light housing and said base mount; and a lighting arrangement provided in said light housing for forming a plurality of light sources of predetermined intensity, wherein when said first housing member and said second housing member are pivotally moved with respect to each other and rotatably moved about said first longitudinal axis and said second longitudinal axis respectively, said light sources are arranged to selectively provide illumination towards two illumination directions corresponding to an orientation of said first housing member and said second housing member respectively.

According to the preferred embodiment of the present invention, the light housing further comprises a base housing member wherein the first housing member and the second housing member are pivotally mounted to the base housing member so that each of the first housing member and the second housing member are capable of pivotally moving with respect to the base housing member.

The base housing member comprises a top aesthetic member crafted and designed to form a predetermined pattern, and a base receiving member provided underneath the top aesthetic member for receiving the illuminators.

The base receiving member has a supporting portion and a protruded housing portion downwardly and integrally extended from the supporting base portion, wherein the illuminators are received in the housing portion for providing illumination toward a downward direction of the base housing member.

The lighting apparatus further comprises an operation switch, wherein the base receiving member further has an operation portion upwardly and integrally extended from a rear side of the supporting portion for accommodating the operation switch for controlling an operation of the lighting arrangement.

The top aesthetic member is overlappedly attached on a top side of the base receiving member and is aligned with the operation portion of the base receiving member for providing an aesthetic appearance to the lighting apparatus.

The first housing member is elongated in shape and has a first housing cavity and a first housing opening communicating the first housing cavity with an exterior of the first housing member, wherein the second housing member is elongated in shape and has a second first housing cavity and a second housing opening communicating the second housing cavity with an exterior of the second housing member, wherein the illuminators are also received in the first housing cavity and the second housing cavity, wherein the illumination generated by the corresponding illuminators propagates out of the first housing member and the second housing member through the first housing opening and the second housing opening respectively.

The light housing further comprises a first pivotal joint and a second pivotal joint mounted on two sides of the base housing member respectively, wherein the first housing member and the second housing member are mounted on the first pivotal joint and the second pivotal joint respectively so as to pivotally mount on the base housing member.

The first pivotal joint comprises a first joint body mounted on a side edge portion of the base receiving member of the base housing member, and a first connecting member rotatably mounted on the first joint body such that the first connecting member is capable of rotating about a longitudinal axis of the first joint body.

The second pivotal joint comprises a second joint body mounted on a side edge portion of the base receiving member of the base housing member at a position opposite to the first pivotal joint, and a second connecting member rotatably mounted on the second joint body such that the second connecting member is capable of rotating about a longitudinal axis of the second joint body.

The first connecting member has a first longitudinal portion rotatably connected to the first joint body, and a first transverse portion transversely extended from the first longitudinal portion and is rotatably connected to the first housing member.

The second connecting member has a second longitudinal portion rotatably connected to the second joint body, and a second transverse portion transversely extended from the second longitudinal portion and is rotatably connected to the second housing member.

Furthermore, the first housing member and the second housing member are shaped and sized to form a first clearance and a second clearance defined between a top surface of the first housing member and the supporting portion of the base receiving member, and between the second housing member and the supporting portion of the base receiving member respectively, wherein the first clearance and the second clearance allow the first housing member and the second housing member to be slightly and outwardly rotated about their longitudinal axis respectively even when the first housing member and the second housing member are not pivotally moved away from the base receiving member.

On the other hand, the lighting arrangement further comprises a control circuitry mounted in the light housing and is electrically connected to the illuminators and the operation switch, wherein control circuitry is programmed to control an illumination pattern of the illuminators so that the illuminators received in the first housing member, the second housing member and the base receiving member are arranged to be controlled to generate different lighting effects.

The first housing member has a first top surface which is curved for forming the first clearance, wherein the second housing member has a second top surface which is also curved for forming the second clearance.

The lighting arrangement further comprises a battery tray mounted between the top aesthetic member and the base receiving member, wherein the battery tray is adapted for detachably receiving at least one battery for providing power for the illuminators.

Thus, the top aesthetic member is movably and detachably mounted on the base receiving member for selectively exposing the battery tray to an exterior of the light housing so as to allow a user to replace the battery disposed in the battery tray.

On the other hand, the extension member is designed to have a predetermined flexibility and is extended between the base mount and the light housing in such a manner that a user is able to adjust a position of the light housing by slightly deforming a shape of the extension member.

The base mount comprises a clamping base provided at a lower end portion of the extension member, wherein the clamping base has an elongated longitudinal portion longitudinally extended from the lower end portion of the extension member, a first transverse portions transversely and spacedly extended from an upper end of the longitudinal portion, and a second transverse portion transversely extended from a lower end of the longitudinal portion and is positioned to be spacedly apart from the first transverse portion so as to constitute a substantially U-shaped cross sectional shape, and define a clamping cavity formed between the elongated longitudinal portion, the first transverse portion, and the second transverse portion, wherein the clamping base further has a through clamping hole formed on the second transverse portion, wherein the clamping hole is threaded on a sidewall thereof.

The base mount further comprises a mounting shaft arranged to threadedly engage with the threaded sidewall of the clamping hole, in such a manner that when the mounting shaft is rotated, the mounting shaft is arranged to vertically move along a longitudinal direction of the base mount.

The above mentioned objectives, features, and advantages of the present invention will be more clearly described and shown in the following detailed description, drawings, and the claims.

DETAILED DESCRIPTION OF THE PREFERRED EMBODIMENT

Figure 1:
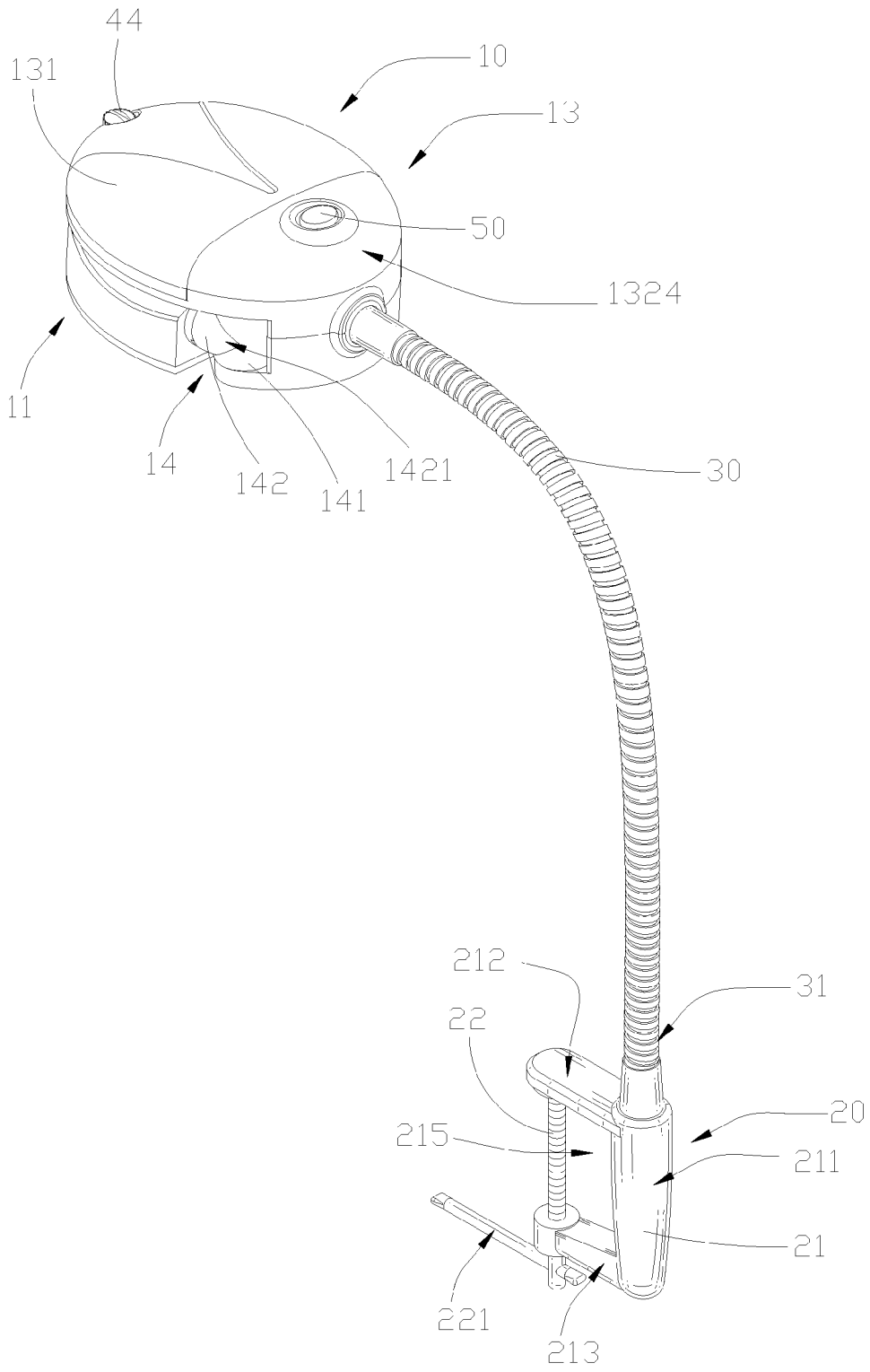
FIG. 1 is a perspective view of a lighting apparatus according to a preferred embodiment of the present invention.

Referring to FIG. 1, FIG. 2A, FIG. 2B, and FIG. 3 to FIG. 7 of the drawings, a lighting apparatus, such as a barbeque light, according to a preferred embodiment of the present invention is illustrated, in which the lighting apparatus comprises a light housing 10 comprising a first housing member 11 and a second housing member 12, a base mount 20, an extension member 30 extended between the light housing 10 and the base mount 20, and a lighting arrangement 40.

The first housing member 11 is moveably supported such that the first housing member 11 is capable of rotating about a first longitudinal axis thereof. Similarly, the second housing member 12 is movably supported such that the second housing member 12 is capable of rotating about a second longitudinal axis thereof, wherein the second housing member 12 is pivotally movable with respect to the first housing member 11.

The lighting arrangement 40 is provided in the light housing 10 for forming a plurality of light sources of predetermined intensity, wherein when the first housing member 11 and the second housing member 12 are pivotally moved with respect to each other and rotatably moved about the first longitudinal axis and the second longitudinal axis respectively, the light sources are arranged to selectively provide illumination towards two illumination directions corresponding to an orientation of the first housing member 11 and the second housing member respectively 12. When the illumination propagates along different orientations, different lighting effects are thereby generated to accomplish different practical purposes.

According to the preferred embodiment of the present invention, the lighting arrangement 40 comprises a plurality of illuminators 41 received in the light housing 10 for providing illumination to generate the different lighting effects as mentioned above.

On the other hand, the light housing 10 further comprises a base housing member 13 wherein the first housing member 11 and the second housing member 12 are pivotally mounted to the base housing member 13 so that each of the first housing member 11 and the second housing member 12 are capable of pivotally moving with respect to the base housing member 13 and with respect to each other.

More specifically, the base housing member 13 comprises a top aesthetic member 131 crafted and designed to form a predetermined pattern such as a bug-like aesthetic appearance, and a base receiving member 132 provided underneath the top aesthetic member 131 for receiving the illuminators 41. As shown in FIG. 2 of the drawings, the base receiving member 132 has a supporting portion 1321 and a protruded housing portion 1322 downwardly and integrally extended from the supporting base portion 1321, wherein the illuminators 41 are received in the housing portion 1322 for providing illumination toward a downward direction of the base housing member 13. Thus, the base receiving member 132 further has a housing opening 1323 formed on the housing portion 1322, wherein the illumination generated by the illuminators 41 is arranged to reach an exterior of the base housing member 13 through the housing opening 1323.

Furthermore, the base receiving member 132 further has an operation portion 1324 upwardly and integrally extended from a rear side of the supporting portion 1321, for accommodating an operation switch 50 of the present invention. In other words, the portable charger kit further comprises the operation switch 50 provided on the operation portion 1324 of the base receiving member 132 for controlling an operation of the lighting arrangement 40.

The top aesthetic member 131 is overlappedly attached on a top side of the base receiving member 132 and is aligned with the operation portion 1324 of the base receiving member 132 for providing an aesthetic appearance to the lighting apparatus as a whole. The top aesthetic member 131, however, is not only utilized for aesthetic purpose. Rather, it can also protect the base receiving member 132 and the first housing member 11 and the second housing member 12 so as to ensure that the electrical components of the present invention are well accommodated and protected.

The first housing member 11 is elongated in shape and has a first housing cavity 111 and a first housing opening 112 communicating the first housing cavity 111 with an exterior of the first housing member 11. On the other hand, the second housing member 12 is also elongated in shape and has a second first housing cavity 121 and a second housing opening 122 communicating the second housing cavity 121 with an exterior of the second housing member 12. The corresponding illuminators 41 are received in the first housing cavity 111 and the second housing cavity 121, wherein the illumination propagates out of the first housing member 11 and the second housing member 12 through the first housing opening 112 and the second housing opening 122 respectively.

Furthermore, the light housing 10 further comprises a plurality of illuminator covers 17 mounted at the first housing opening 112, the second housing opening 122, and the housing opening 1323 of the base receiving member 132 respectively for protecting the illuminators 41 received in the first housing 11, the second housing 12, and the base receiving member 132.

The extension member 30 is designed to have a predetermined flexibility and is extended between the base mount 20 and the light housing 10 in such a manner that a user is able to adjust the position of the light housing 10 by slightly deforming a shape of the extension member 30.

The base mount 20 comprises a clamping base 21 provided at a lower end portion 31 of the extension member 30, and has an elongated longitudinal portion 211 longitudinally extended from the lower end portion 31 of the extension member 30, a first transverse portions 212 transversely and spacedly extended from an upper end of the longitudinal portion 211, and a second transverse portion 213 transversely extended from a lower end of the longitudinal portion 211 and is positioned to be spacedly apart from the first transverse portion 212 so as to constitute a substantially U-shaped cross sectional shale on the part of the clamping base 21 and a clamping cavity 215 formed between the elongated longitudinal portion 211, the first transverse portion 212, and the second transverse portion 213. Moreover, the clamping base 21 further has a through clamping hole 214 formed on the second transverse portion 213. In this preferred embodiment, the clamping hole 214 is threaded on a sidewall thereof.

In order to mount the lighting apparatus onto an external object, the base mount 20 further comprises a mounting shaft 22 arranged to threadedly engage with the threaded sidewall of the clamping hole 214. Thus, by rotating the mounting shaft 22, the mounting shaft 22 is arranged to vertically move along a longitudinal direction of the base mount 20.

Accordingly, the mounting shaft 22 further has a lower turning handle 221 and an enlarged upper clamping end 222 formed thereon, wherein when an external object is placed in the clamping cavity 215, the user is able to turn and mounting shaft 22 through by turning the lower turning handle 221 so as to move the upper clamping end 222 upwardly along the clamping cavity 215 until the upper clamping end 222 biases against the external object so as to mount the lighting apparatus onto that external object.

Figure 2A:
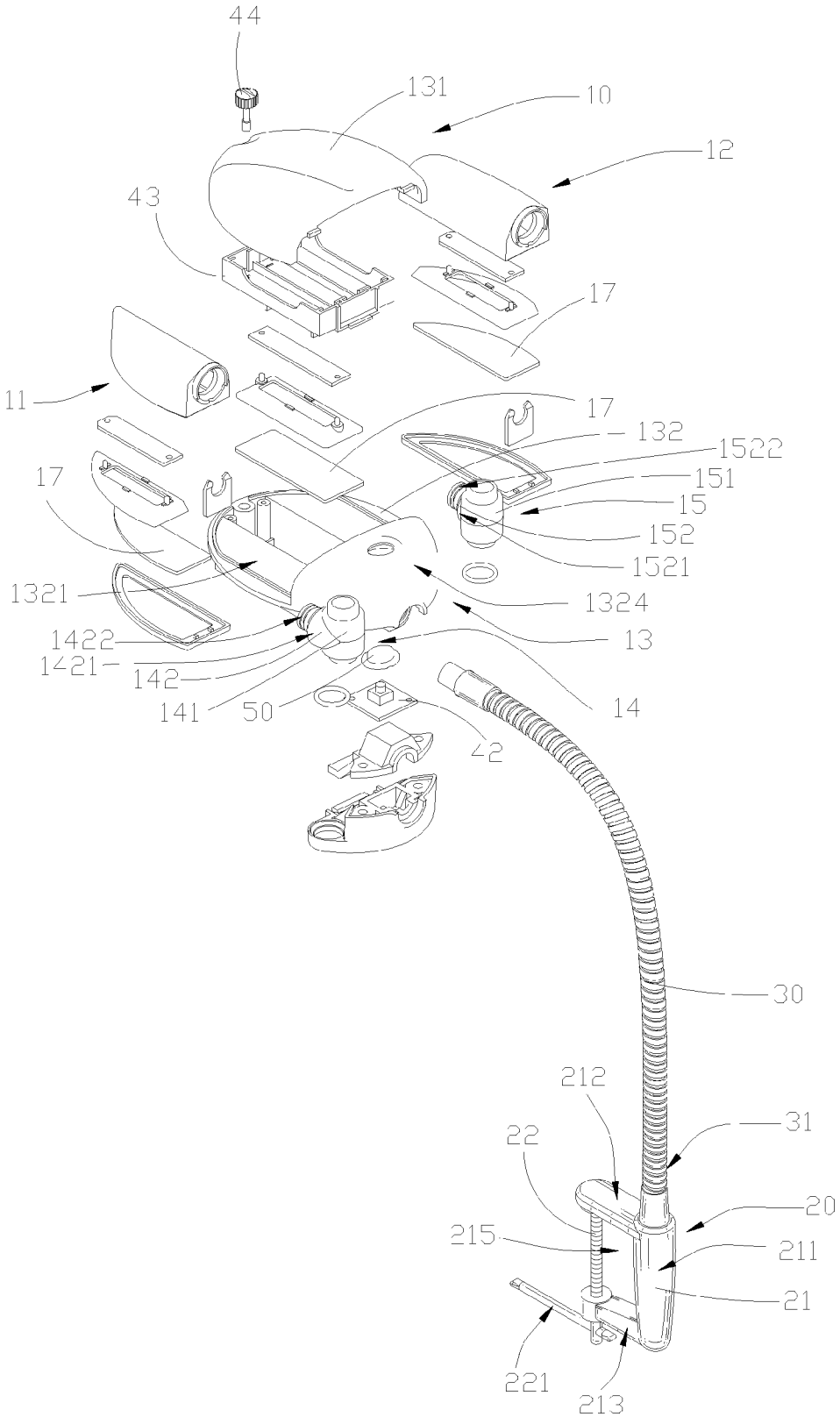
FIG. 2A and FIG. 2B are exploded perspective views of the lighting apparatus according to the preferred embodiment of the present invention.
Figure 2B:
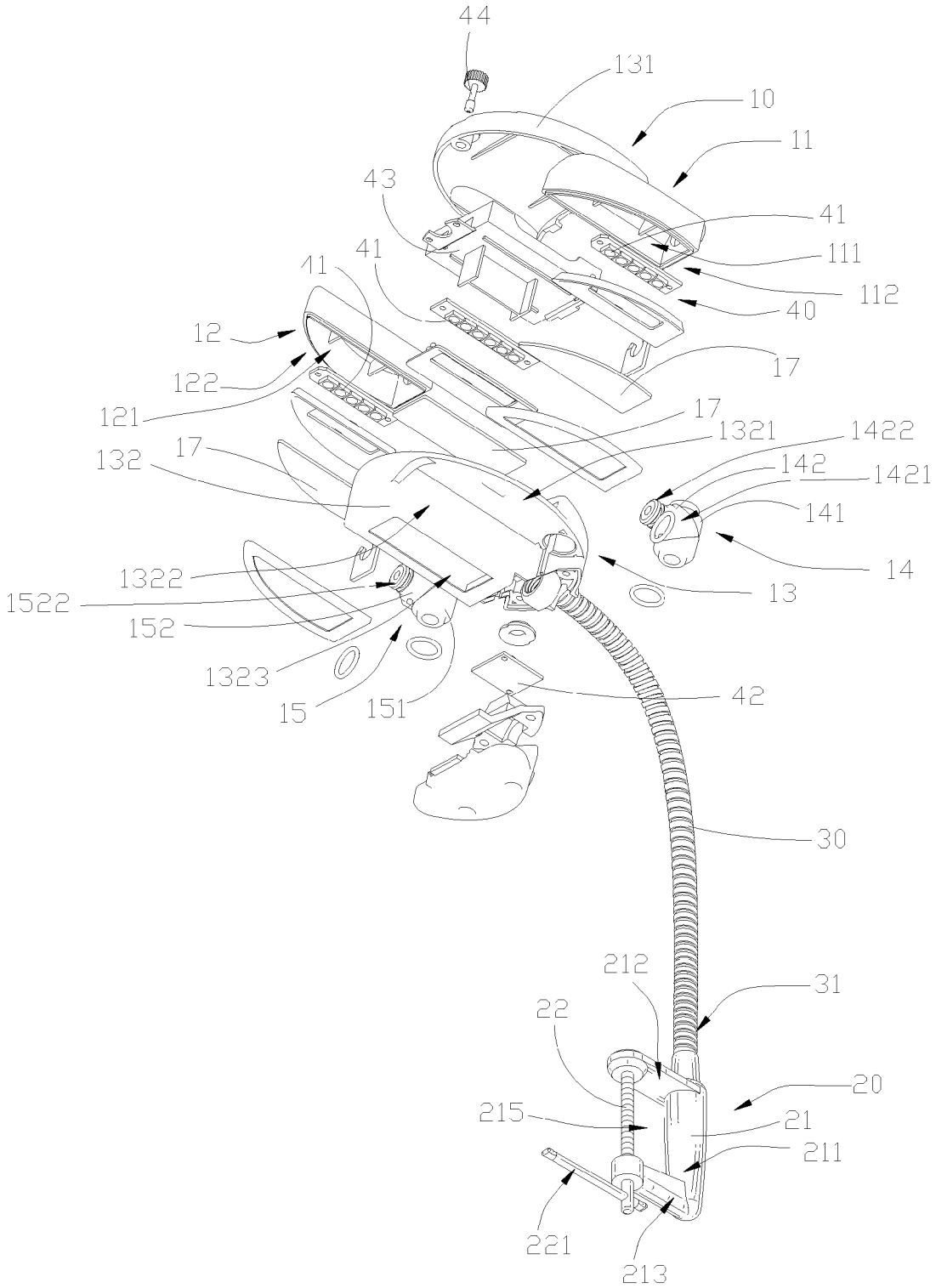

As shown in FIG. 1, FIG. 2A to FIG. 2B of the drawings, the light housing 10 further comprises a first pivotal joint 14 and a second pivotal joint 15 mounted on two sides of the base housing member 13 respectively, wherein the first housing member 11 and the second housing member 12 are mounted on the first pivotal joint 14 and the second pivotal joint 15 respectively so as to pivotally mount on the base housing member 13.

More specifically, the first pivotal joint 14 comprises a first joint body 141 mounted on a side edge portion of the base receiving member 132 of the base housing member 13, and a first connecting member 142 rotatably mounted on the first joint body 141 such that the first connecting member 142 is capable of rotating about a longitudinal axis of the first joint body 141. As shown in FIG. 2A and FIG. 2B of the drawings, the first joint body 141 is tubular in structure and has substantially circular cross sectional area.

Similarly, the second pivotal joint 15 comprises a second joint body 151 mounted on a side edge portion of the base receiving member 132 of the base housing member 13 at a position opposite to the first pivotal joint 14, and a second connecting member 152 rotatably mounted on the second joint body 151 such that the second connecting member 152 is capable of rotating about a longitudinal axis of the second joint body 151. As shown in FIG. 2A and FIG. 2B of the drawings, the second joint body 151 is also tubular in structure and has substantially circular cross sectional area.

On the other hand, the first connecting member 142 has a first longitudinal portion 1421 rotatably connected to the first joint body 141, and a first transverse portion 1422 transversely extended from the first longitudinal portion 1421 and is rotatably connected to the first housing member 11. Thus, the first housing member 11 can be rotated with respect to the first transverse portion 1422 (i.e. about a longitudinal axis of the first housing member 11). Moreover, since the first connecting member 142 is rotatably mounted to the first joint body 141, the first housing member 11, being connected to the first connecting member 142, is also rotatable with respect to the first joint body 141 (i.e. about a longitudinal axis of the first joint body 141).

Similarly, the second connecting member 152 has a second longitudinal portion 1521 rotatably connected to the second joint body 151, and a second transverse portion 1522 transversely extended from the second longitudinal portion 1521 and is rotatably connected to the second housing member 12. Thus, the second housing member 12 can be rotated with respect to the second transverse portion 1522 (i.e. about a longitudinal axis of the second housing member 12). Moreover, since the second connecting member 152 is rotatably mounted to the second joint body 151, the second housing member 12, being connected to the second connecting member 152, is also rotatable with respect to the second joint body 151 (i.e. about a longitudinal axis of the second joint body 151).

In this preferred embodiment, an external contour of an outer peripheral edge of the top aesthetic member 131 is designed and crafted to be substantially the same as the outer peripheral contour of the first housing member 11 and the second housing member 12 and the base receiving member 132 so that when the first housing member 11 and the second housing member 12 are pivotally moved to align with the base receiving member 132, the top aesthetic member 131 is arranged to fittedly overlap on the first housing member 11, the base receiving member 132 and the second housing member 12. As such, the aesthetic appearance of the top aesthetic member 131 is imparted to the entire light housing 10.

From the above description, it can be appreciated that by pivotally and rotatably moving the first housing member 11 and the second housing member 12, different lighting effects can be created so that the present invention is capable of generating illumination in more than one orientation at the same time. As a result, the lighting apparatus can accomplish different lighting objective at the same time.

For example, as shown in FIG. 1 of the drawings, when the first housing member 11, the second housing member 12 and the base receiving member 132 are aligned with each other, the illumination generated from the illuminators 41 point in substantially the same orientation (i.e. pointing downwardly with respect to the light housing 10 in normal circumstances). The intensity of the illumination generated by the light apparatus is at the maximum because all the illuminators 41 point toward a single orientation. When the lighting apparatus is used as a barbeque light, the light generated from the light housing 10 may be used to illuminate the food placed on a barbeque food rack.

Figure 4:
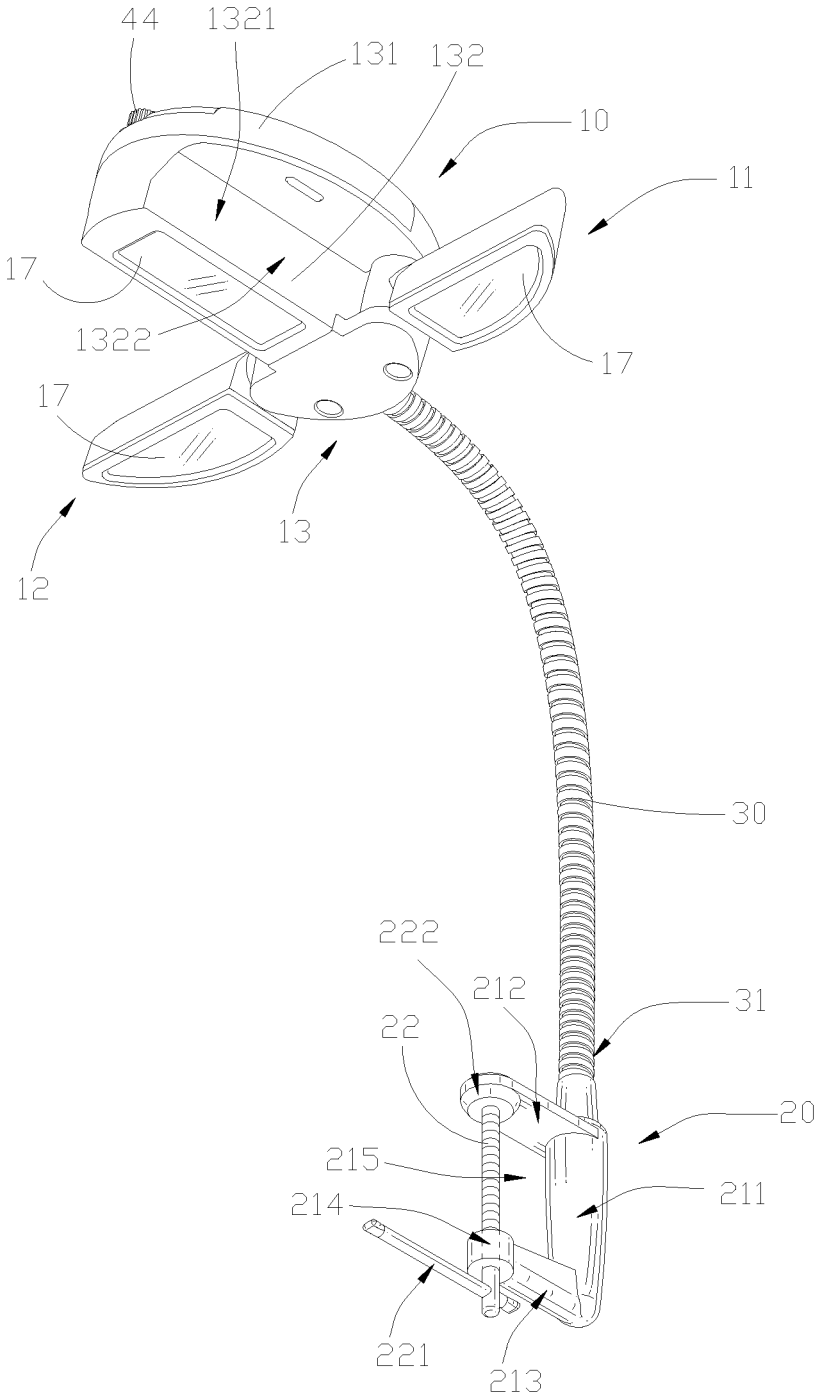
FIG. 4 is another perspective view of the lighting apparatus according to the preferred embodiment of the present invention.
Figure 5:
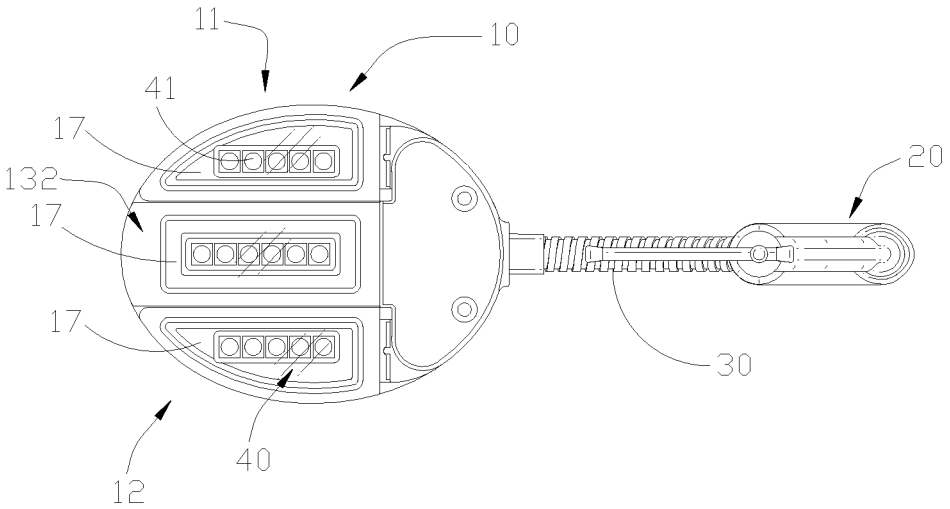
FIG. 5 is a schematic diagram of the lighting apparatus according to the preferred embodiment of the present invention, illustrating the bottom side of the light housing.

As shown in FIG. 4 of the drawings, when the first housing member 11 and the second housing member 12 are pivotally moved away from the base receiving member 132, the illumination area under the light housing 10 is increased to an extent which is proportional to the angles of inclination between the first housing member 11 and the base receiving member 132, and between the second housing member 12 and the base receiving member 132. In this illumination pattern, although the light intensity of the illumination generated by the light housing 10 is slightly decreased when compared with the illumination pattern mentioned in the preceding paragraph, the illumination area increases accordingly. So this illumination pattern is suitable when users wish to have a wider or larger area of illumination. According to the preferred embodiment of the present invention, each of the first housing member 11 and the second housing member 12 can be pivotally moved away from the base receiving member 132 to form an angle of inclination between 0 degree and approximately 170 degrees.

Figure 3:
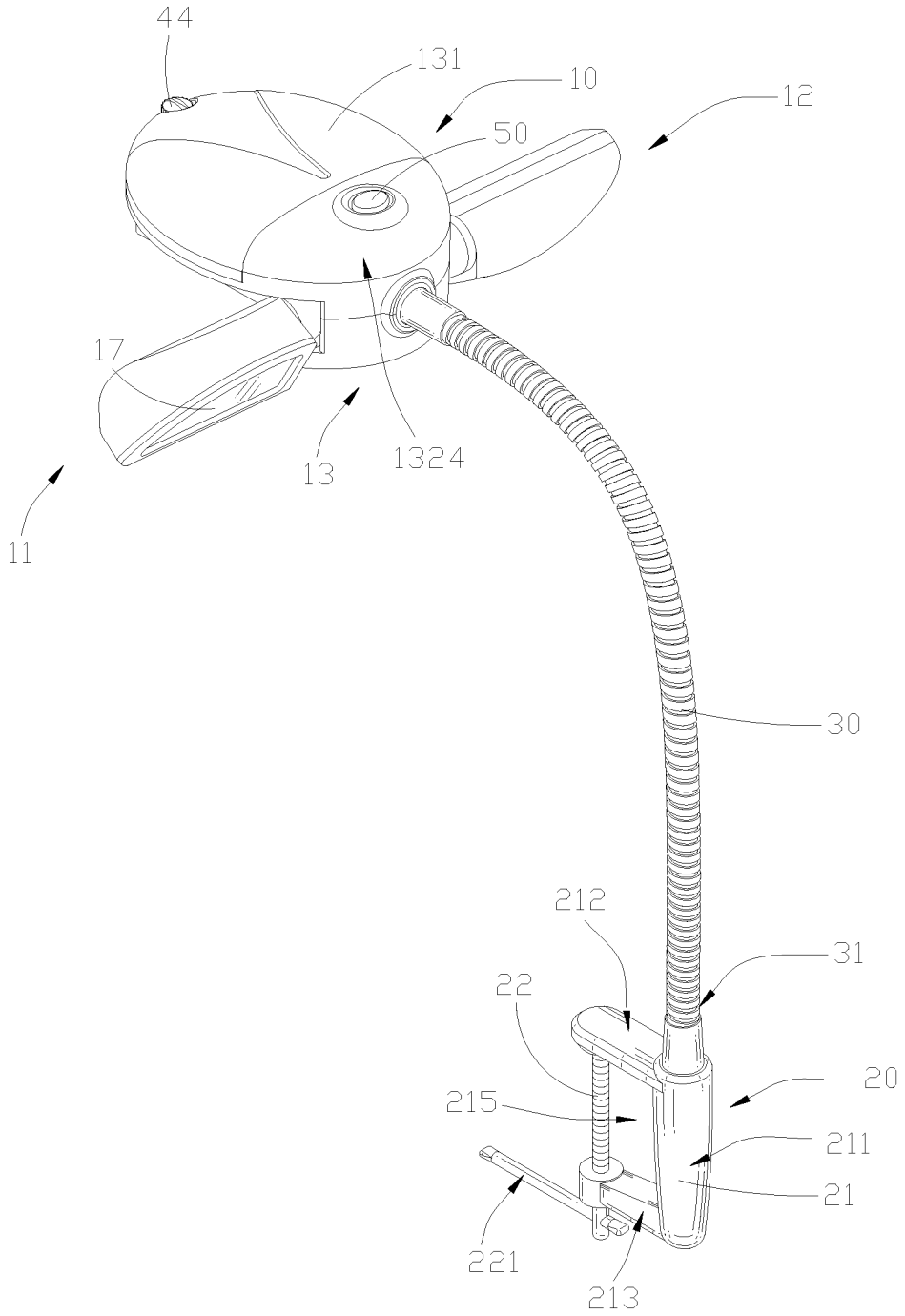
FIG. 3 is a schematic diagram of the lighting apparatus according to a preferred embodiment of the present invention.

As shown in FIG. 3 of the drawings, when either one (or both) of the first housing member 11 or the second housing member 12 rotates about a longitudinal axis thereof, the illuminating orientation changes substantially. In this scenario, the illuminators 41 received in the first housing member 11 or the second housing member 12 point toward an orientation which corresponds to the orientation of the first housing member 11 or the second housing member 12. For example, the first housing member 11 may be rotated in a direction which is away from the base receiving member 132 (i.e. outwardly rotated) so that the light generated by the illuminators 41 received in the first housing member 11 can be used to illuminate objects positioned at a corresponding side of the lighting apparatus. When the lighting apparatus is used as a barbeque light, this side illumination can be used to provide light to the user for, say, seeing his or her watch. It is important to mention here is that while the first housing member 11 or the second housing member 12 (or both) are rotated to provide side illumination to users of the present invention, the illuminators 41 received in the base receiving member 132 can still be used to provide light under the light housing 10. In other words, the lighting apparatus is capable of simultaneously providing illumination to many different orientations.

According to the preferred embodiment of the present invention, each of the first housing member 11 and the second housing member 12 are capable of rotating about the corresponding longitudinal axis for 360 degrees.

In order to further increase the lighting effect of the present invention, the lighting arrangement 40 further comprises a control circuitry 42 mounted in the light housing 10 and is electrically connected to the illuminators 41 and the operation switch 50. The control circuitry 42 can be programmed to control the illumination pattern of the illuminators 41 so that the illuminators 41 received in the first housing member 11, the second housing member 12 and the base receiving member 132 can be controlled to generate different lighting effects. For example, the illuminators 41 received in the first housing member 11 can be controlled to blink at a predetermined frequency.

In the preferred embodiment of the present invention, each of the illuminator covers 17 is transparent so as to allow the light to come out from the first housing member 11, the second housing member 12, and the base receiving member 132. However, the illuminator covers 17 can also be made to have other colors or imparted with aesthetic patterns so as to further enhance the lighting effect of the present invention. Thus, while the lighting apparatus of the present invention is best used as a barbeque light, it can also be used to illuminator other objects and used in different circumstances, such as used as a book light.

Figure 6:
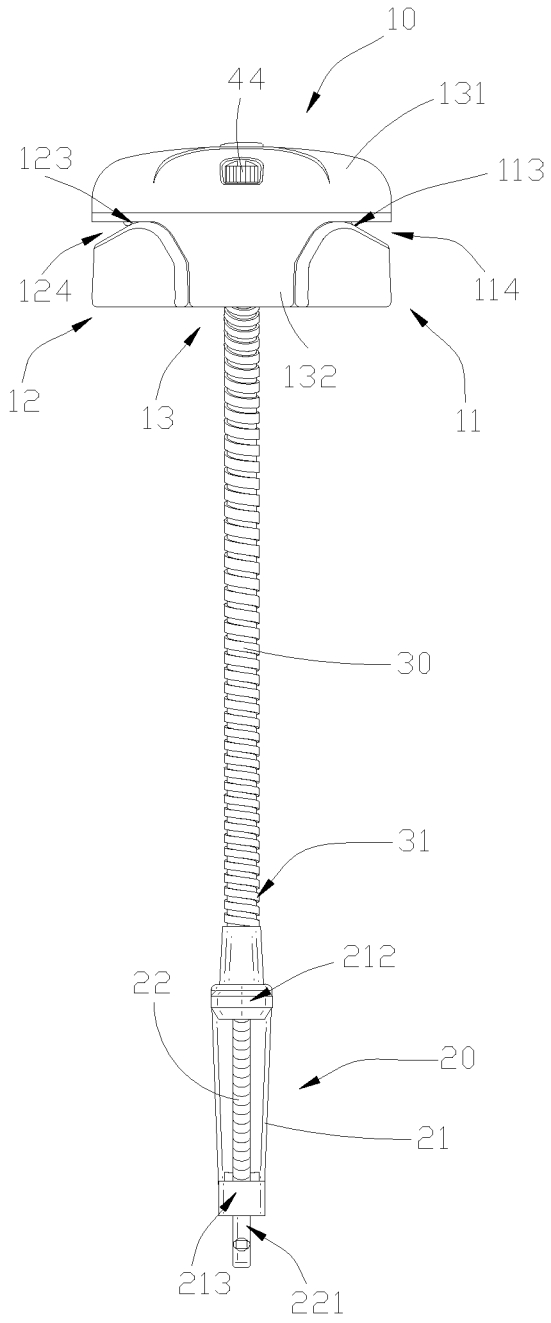
FIG. 6 is a front view of the lighting apparatus according to the preferred embodiment of the present invention.
Figure 7:
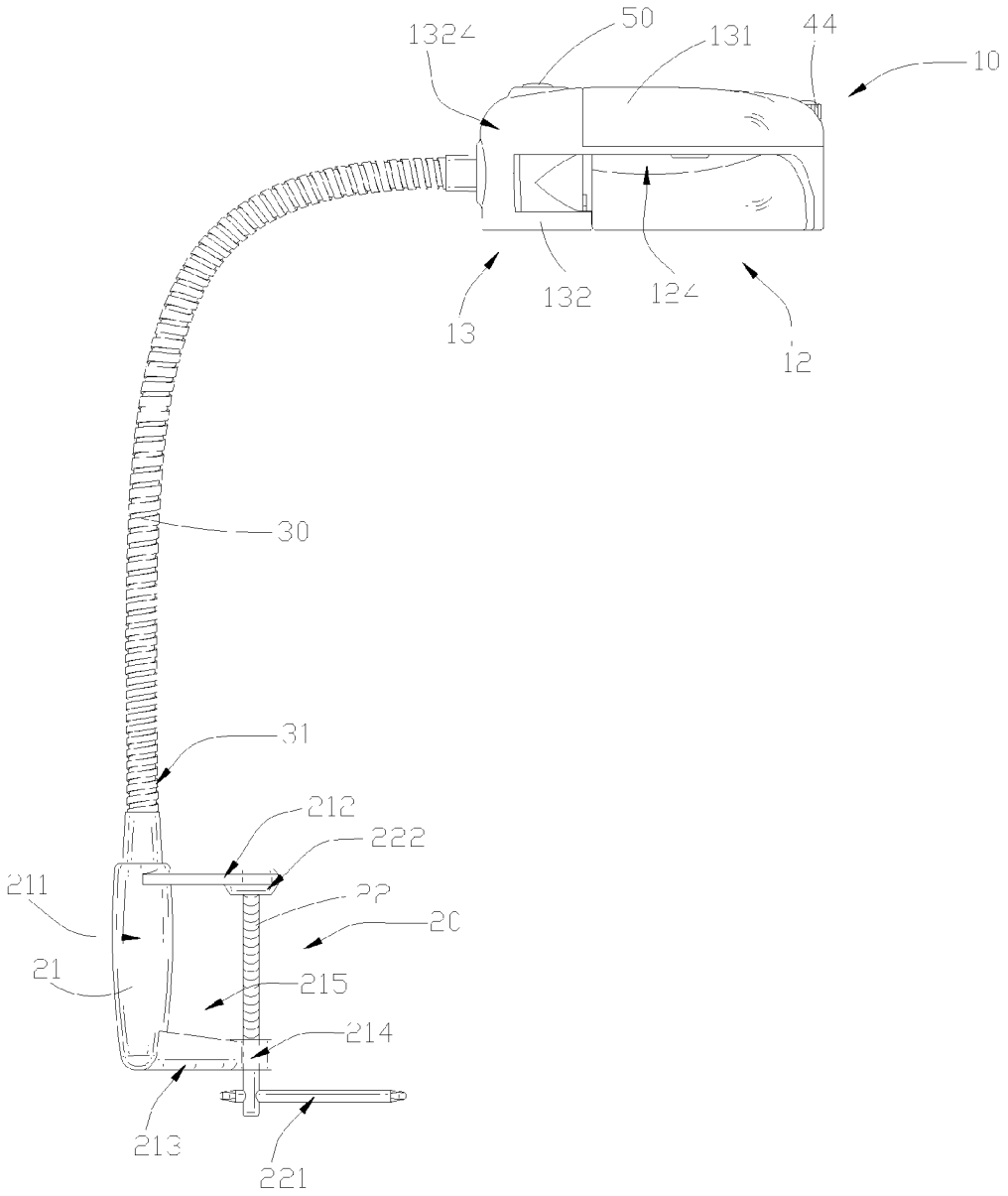
FIG. 7 is a side view of the lighting apparatus according to the preferred embodiment of the present invention.

Moreover, as shown in FIG. 6 to FIG. 7 of the drawings, the first housing member 11 and the second housing member 12 are shaped and sized to form a first clearance 114 and a second clearance 124 defined between a top surface of the first housing member 11 and the supporting portion 1321 of the base receiving member 132, and between the second housing member 12 and the supporting portion 1321 of the base receiving member 132 respectively. These clearances 114, 124 allow the first housing member 11 and the second housing member 12 to slightly and outwardly rotate about their longitudinal axis respectively even when they are not pivotally moved away from the base receiving member 132.

In order to further facilitate these features, the first housing member 11 has a first top surface 113 which is curved for forming the first clearance 114. Similarly, the second housing member 12 has a second top surface 123 which is also curved for forming the second clearance 124.

Referring to FIG. 2A and FIG. 2B of the drawings, the lighting apparatus of the present invention preferably utilizes disposable or rechargeable batteries as a power source for operating the illuminators 41. More specifically, the lighting arrangement 40 further comprises a battery tray 43 mounted between the top aesthetic member 131 and the base receiving member 132, wherein the battery tray 43 is adapted for receiving at least one battery, such as a Ni—MH disposable battery or other suitable rechargeable battery, for providing power for the illuminators 41. Thus, the battery tray 43 is electrically connected to the control circuitry 42 so that it can manage and control the power delivered to the illuminators 41. Alternatively, it is worth mentioning that the lighting apparatus can also utilize AC as a power source. In such a scenario, the lighting apparatus is electrically connected to an external AC power source for acquiring electricity for operating the illuminators 41.

Accordingly, the top aesthetic member 131 is movably mounted on the base receiving member 132 for selectively exposing the battery tray 43 to an exterior of the light housing 10 so as to allow a user to replace the battery disposed in the battery tray 43. A locking member 44 is provided at a front end portion of the top aesthetic member 131 for selectively locking the aesthetic member 131 on the base receiving member 132.

One skilled in the art will appreciate that the embodiment of the present invention as shown in the drawings and described above is illustrative only and not intended to be limiting. All embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighting apparatus, comprising:

a light housing which comprises:

a first housing member moveably supported such that said first housing member is capable of rotating about a first longitudinal axis thereof; and a second housing member movably supported such that said second housing member is capable of rotating about a second longitudinal axis thereof, wherein said second housing member is also pivotally movable with respect to said first housing member;

a base mount;

an extension member extended between said light housing and said base mount; and a lighting arrangement which comprises a plurality of illuminators provided in said light housing for forming a plurality of light sources of predetermined intensity, wherein when said first housing member and said second housing member are pivotally moved with respect to each other and rotatably moved about said first longitudinal axis and said second longitudinal axis respectively, said light sources are arranged to selectively provide illumination towards two illumination directions corresponding to an orientation of said first housing member and said second housing member respectively, wherein said light housing further comprises a base housing member wherein said first housing member and said second housing member are pivotally mounted to said base housing member so that each of said first housing member and said second housing member are capable of pivotally moving with respect to said base housing member.

2. The lighting apparatus, as recited in claim 1, wherein said base housing member comprises a top aesthetic member crafted and designed to form a predetermined pattern, and a base receiving member provided underneath said top aesthetic member for receiving said illuminators.

3. The lighting apparatus, as recited in claim 2, wherein said base receiving member has a supporting portion and a protruded housing portion downwardly and integrally extended from said supporting base portion, wherein said illuminators are received in said housing portion for providing illumination toward a downward direction of said base housing member.

4. The lighting apparatus, as recited in claim 3, further comprising an operation switch, wherein said base receiving member further has an operation portion upwardly and integrally extended from a rear side of said supporting portion for accommodating said operation switch for controlling an operation of said lighting arrangement.

5. The lighting apparatus, as recited in claim 4, wherein said top aesthetic member is overlappedly attached on a top side of said base receiving member and is aligned with said operation portion of said base receiving member for providing an aesthetic appearance to said lighting apparatus.

6. The lighting apparatus, as recited in claim 5, wherein said first housing member is elongated in shape and has a first housing cavity and a first housing opening communicating said first housing cavity with an exterior of said first housing member, wherein said second housing member is elongated in shape and has a second first housing cavity and a second housing opening communicating said second housing cavity with an exterior of said second housing member, wherein said illuminators are also received in said first housing cavity and said second housing cavity, wherein said illumination generated by said corresponding illuminators propagates out of said first housing member and said second housing member through said first housing opening and said second housing opening respectively.

7. The lighting apparatus, as recited in claim 6, wherein said light housing further comprises a first pivotal joint and a second pivotal joint mounted on two sides of said base housing member respectively, wherein said first housing member and said second housing member are mounted on said first pivotal joint and said second pivotal joint respectively so as to pivotally mount on said base housing member.

8. The lighting apparatus, as recited in claim 7, wherein said first pivotal joint comprises a first joint body mounted on a side edge portion of said base receiving member of said base housing member, and a first connecting member rotatably mounted on said first joint body such that said first connecting member is capable of rotating about a longitudinal axis of said first joint body.

9. The lighting apparatus, as recited in claim 8, wherein said second pivotal joint comprises a second joint body mounted on a side edge portion of said base receiving member of said base housing member at a position opposite to said first pivotal joint, and a second connecting member rotatably mounted on said second joint body such that said second connecting member is capable of rotating about a longitudinal axis of said second joint body.

10. The lighting apparatus, as recited in claim 9, wherein said first connecting member has a first longitudinal portion rotatably connected to said first joint body, and a first transverse portion transversely extended from said first longitudinal portion and is rotatably connected to said first housing member.

11. The lighting apparatus, as recited in claim 10, wherein said second connecting member has a second longitudinal portion rotatably connected to said second joint body, and a second transverse portion transversely extended from said second longitudinal portion and is rotatably connected to said second housing member.

12. The lighting apparatus, as recited in claim 11, wherein said first housing member and said second housing member are shaped and sized to form a first clearance and a second clearance defined between a top surface of said first housing member and said supporting portion of said base receiving member, and between said second housing member and said supporting portion of said base receiving member respectively, wherein said first clearance and said second clearance allow said first housing member and said second housing member to be slightly and outwardly rotated about their longitudinal axis respectively even when said first housing member and said second housing member are not pivotally moved away from said base receiving member.

13. The lighting apparatus, as recited in claim 12, wherein said lighting arrangement further comprises a control circuitry mounted in said light housing and is electrically connected to said illuminators and said operation switch, wherein control circuitry is programmed to control an illumination pattern of said illuminators so that said illuminators received in said first housing member, said second housing member and said base receiving member are arranged to be controlled to generate different lighting effects.

14. The lighting apparatus, as recited in claim 13, wherein said first housing member has a first top surface which is curved for forming said first clearance, wherein said second housing member has a second top surface which is also curved for forming said second clearance.

15. The lighting apparatus, as recited in claim 14, wherein said lighting arrangement further comprises a battery tray mounted between said top aesthetic member and said base receiving member, wherein said battery tray is adapted for detachably receiving at least one battery for providing power for said illuminators.

16. The lighting apparatus, as recited in claim 15, wherein said top aesthetic member is movably and detachably mounted on said base receiving member for selectively exposing said battery tray to an exterior of said light housing so as to allow a user to replace said battery disposed in said battery tray.

17. The lighting apparatus, as recited in claim 16, wherein said extension member is designed to have a predetermined flexibility and is extended between said base mount and said light housing in such a manner that a user is able to adjust a position of said light housing by slightly deforming a shape of said extension member.

18. The lighting apparatus, as recited in claim 17, wherein said base mount comprises a clamping base provided at a lower end portion of said extension member, wherein said clamping base has an elongated longitudinal portion longitudinally extended from said lower end portion of said extension member, a first transverse portions transversely and spacedly extended from an upper end of said longitudinal portion, and a second transverse portion transversely extended from a lower end of said longitudinal portion and is positioned to be spacedly apart from said first transverse portion so as to constitute a substantially U-shaped cross sectional shape, and define a clamping cavity formed between said elongated longitudinal portion, said first transverse portion, and said second transverse portion, wherein said clamping base further has a through clamping hole formed on said second transverse portion, wherein said clamping hole is threaded on a sidewall thereof.

19. The lighting apparatus, as recited in claim 18, wherein said base mount further comprises a mounting shaft arranged to threadedly engage with said threaded sidewall of said clamping hole, in such a manner that when said mounting shaft is rotated, said mounting shaft is arranged to vertically move along a longitudinal direction of said base mount.

* * * * *